US007798325B2

(12) United States Patent
Wizemann et al.

(10) Patent No.: US 7,798,325 B2
(45) Date of Patent: Sep. 21, 2010

(54) PACKAGE FOR FELTING NEEDLES

(75) Inventors: Gustav Wizemann, Messstetten-Hossingen (DE); Rene Conzelmann, Burladingen (DE)

(73) Assignee: Groz-Beckerg KG, Albstadt (DE)

( * ) Notice: Subject to any disclaimer, the term of this patent is extended or adjusted under 35 U.S.C. 154(b) by 649 days.

(21) Appl. No.: 11/494,626

(22) Filed: Jul. 28, 2006

(65) Prior Publication Data

US 2007/0023308 A1 Feb. 1, 2007

(30) Foreign Application Priority Data

Jul. 29, 2005 (DE) ..... 10 2005 036 329

(51) Int. Cl.
*B65D 85/28* (2006.01)
*B65D 5/00* (2006.01)
*D05B 85/00* (2006.01)

(52) U.S. Cl. ..... 206/380; 229/113; 223/102

(58) Field of Classification Search ..... 206/380–383, 206/443, 521, 523, 574; 229/112, 113, 115; 223/102–104; 28/115
See application file for complete search history.

(56) References Cited

U.S. PATENT DOCUMENTS

D14,935 S * 4/1884 Rixford ..... D9/432
405,413 A * 6/1889 Hicks ..... 229/117.01
1,931,293 A * 10/1933 Morck ..... 206/362.4
2,246,254 A * 6/1941 Johnston ..... 66/118
3,014,582 A * 12/1961 McGrane ..... 206/380
3,084,788 A * 4/1963 Ford ..... 206/383
3,231,079 A * 1/1966 Ryan, Jr. ..... 206/594
D257,912 S * 1/1981 Kuen-Yi ..... D3/303
4,309,800 A * 1/1982 Foster ..... 28/115
4,714,164 A * 12/1987 Bachner ..... 206/518
5,366,083 A 11/1994 Sos et al.
5,540,333 A * 7/1996 Gonzalez et al. ..... 206/541
5,547,115 A 8/1996 Ambrosius et al.
6,050,483 A * 4/2000 Haraldsson et al. ..... 229/114
6,241,147 B1 * 6/2001 Guidera ..... 229/112
D564,872 S * 3/2008 Kamins ..... D9/418

(Continued)

FOREIGN PATENT DOCUMENTS

DE 92 09 580 U1 11/1992

(Continued)

OTHER PUBLICATIONS

European Search Report for corresponding European app. EP 06014218.

(Continued)

*Primary Examiner*—Mickey Yu
*Assistant Examiner*—Melissa L Lalli
(74) *Attorney, Agent, or Firm*—Fitch, Even, Tabin & Flannery; Norman N. Kunitz

(57) ABSTRACT

A wedge-shaped receptacle (9) is provided for packaging felting needles (8). The wedge shape is configured in such a manner that the felting needles lie in the receptacle in a mutual lateral engagement, that is, they are held approximately parallel to one another and they firmly clamp one another without their tips abutting against the receptacle body. This, on the one hand, results in a particular protection of the felting needles (8) during transportation and, on the other hand, results in a simple handling with the lowest danger of injuries.

10 Claims, 2 Drawing Sheets

U.S. PATENT DOCUMENTS

| | | | | |
|---|---|---|---|---|
| 2005/0087252 | A1 | 4/2005 | Mettler | |
| 2005/0211600 | A1* | 9/2005 | Saito | 206/586 |
| 2006/0191984 | A1* | 8/2006 | Hitosugi | 229/112 |

FOREIGN PATENT DOCUMENTS

| | | | |
|---|---|---|---|
| DE | 198 31 580 | A1 | 4/1999 |
| DE | 198 00 811 | A1 | 7/1999 |
| EP | 0 579 977 | A | 1/1994 |
| EP | 0 751 076 | A | 1/1997 |
| EP | 1 514 961 | A2 | 8/2004 |

OTHER PUBLICATIONS

Office Action w/ English translation for corresponding Japanese App. JP 2006-202061.

* cited by examiner

PACKAGE FOR FELTING NEEDLES

CROSS-REFERENCE TO RELATED APPLICATION

This Application is a U.S. Utility Patent Application which claims priority from German Application No. 10 2005 036 329.6, filed Jul. 29, 2005, the complete disclosure of which is incorporated herein by reference.

BACKGROUND OF THE INVENTION

The invention relates to a needle package, particularly for felting needles and particularly for felting needles having a fineness from gauge 38 and finer, as well as for crown needles having a fineness of gauge 36 and finer. The needle package according to the invention is further adapted for fork needles, particularly those having a fineness of gauge 36 to 43.

Felting needles have long been used in textile technology for fixing. In this process the needles periodically pierce through the non-woven, random-fiber material in rapid succession. This causes needle wear, so that from time to time the needles have to be replaced. Since for each needle change a relatively large quantity of felting needles have to be replaced, the needles are supplied grouped in packages. For example, the needles are packaged in plastic needle boxes. For utilizing the cuboid-shaped inner space, the boxes are filled in such a manner that one half of the needles is oriented in one direction, while the other half faces in the other direction. As rule, a foam insert is provided between the needles and the lid. This type of package may lead to needle damage in very fine felting needles. Even under the effect of their own weight a pressure on the individual needles and, for example, a blow or shock imparted to the package, may be of such a magnitude that the needles deform (for example, bend) plastically, particularly in the region of their working part. In case the needle box is moved axially, that is, in the length direction of the needles contained in the box, the needles may impact on one another at their feet or tips, which may lead to tip damages in the form of flattened tips, bent-together forks or the like. Also, the foot of one needle may damage the tip of another, oppositely-oriented packaged needle.

A further disadvantage resides in the handling of such packages. To be able to remove the needles from the needle box, it is necessary to reach directly into the needles. The purpose is not to grasp the needles at their working parts. Because of the oppositely oriented arrangement of the needles, the operator may be injured by the sharp-edged working parts, particularly by the needle tip or barbs. Because of the oil or anti-rust means adhering to the needles, such injuries are not only burdensome, but are also dangerous.

It is therefore the object of the invention to provide an improved needle package.

SUMMARY OF THE INVENTION

The above object is generally achieved by a needle package that comprises a wedge-shaped receptacle which has a narrow side and a wide side and which is open at its wide side. The needles are inserted into the receptacle basically in the same sense, and the felting needles project from the receptacle partially with their shank and foot. The working parts, on the other hand, are disposed exclusively within the receptacle. In this manner damaging of the working parts of the needles by the needle feet is impossible.

The handling is improved. An operator may hold the wedge-shaped receptacle in one hand and grasp, with the other hand, the holding or foot portions of the felting needles and remove a desired quantity thereof from the receptacle. The operator does not come into contact with the working parts of the felting needles. The danger of injury by the barbs, forks or tips is thus significantly reduced.

Also, the needles are better protected than before in the needle package according to the invention. The needles lie side-by-side in the same orientation thus ensuring that their working parts will not be bent. The receptacle is preferably structured in such a manner that the felting needles are situated at the narrow side of the receptacle without abutting it. In principle, the receptacle may be open at the narrow side. It is preferred, however, that the narrow is of a closed construction for protecting the tips and working parts of the felting needles.

In a needle package thus structured, the operator may grasp the receptacle closed at the narrow side with one hand without coming into contact with either oil or anti-rust means or with the needles and their working parts; thus the operator is not directly exposed to anti-rust oil. In this manner skin irritations are reduced or avoided. The needle has to be grasped only at its foot region. Because in that region the needles regularly are significantly less oiled, the danger potential concerning skin irritations and allergies is minimized. Further, overall less anti-rust oil has to be used. The needles lie in the receptacle closely to one another. The danger of anti-rust oil dripping out resulting in the corrosion of individual needles is significantly reduced.

The cross section of the receptacle and the quantity of felting needles are coordinated to one another in such as manner that the felting needles lie closely packed in the receptacle without play. Preferably, particularly in the region of the receptacle opening, that is, in the region of their upper shank, they have no play, so that they are firmly wedged against one another in the receptacle. The receptacle preferably has a rectangular cross section; it may, however, be designed to have a different shape. The receptacle continuously increases from its narrow side toward its wide side, whereby it preferably has the shape of a truncated pyramid. The surface ratio of the narrow side to the wide side corresponds preferably to the cross-sectional surface ratio of the felting needles between the working part and the shank part. Such an arrangement likewise provides that the felting needles snugly fit, side-by-side, in the truncated pyramidal receptacle without any rattle. The dimensions of the receptacle and the quantity of the needles are coordinated with one another in such a manner that the needle tips are at a slight distance from the narrow end face of the receptacle. Such an arrangement prevents damages during transportation even in case of rough handling and delicate needle structures.

The receptacle is preferably made of a plastic material. At its upper edge it may be provided with one or more tabs, by means of which the receptacle may be removed from a transporting package, such as a box. The tabs may also serve as securing means, for example, by temporarily attaching the receptacles to a suitable stand.

The box for receiving the receptacle is preferably of a plastic material. In a further preferred embodiment, in the box one or preferably two buffers are arranged which are associated with the narrow and the wide sides of the receptacle and between which the receptacle is disposed with the felting needles. In this manner the felting needles disposed in the receptacle may be held in a play-free manner.

Further details of advantageous embodiments are contained in the drawing, the description or the claims.

BRIEF DESCRIPTION OF THE DRAWINGS

In the drawing, which shows embodiments of the invention.

DETAILED DESCRIPTION OF THE INVENTION

Figure 1:
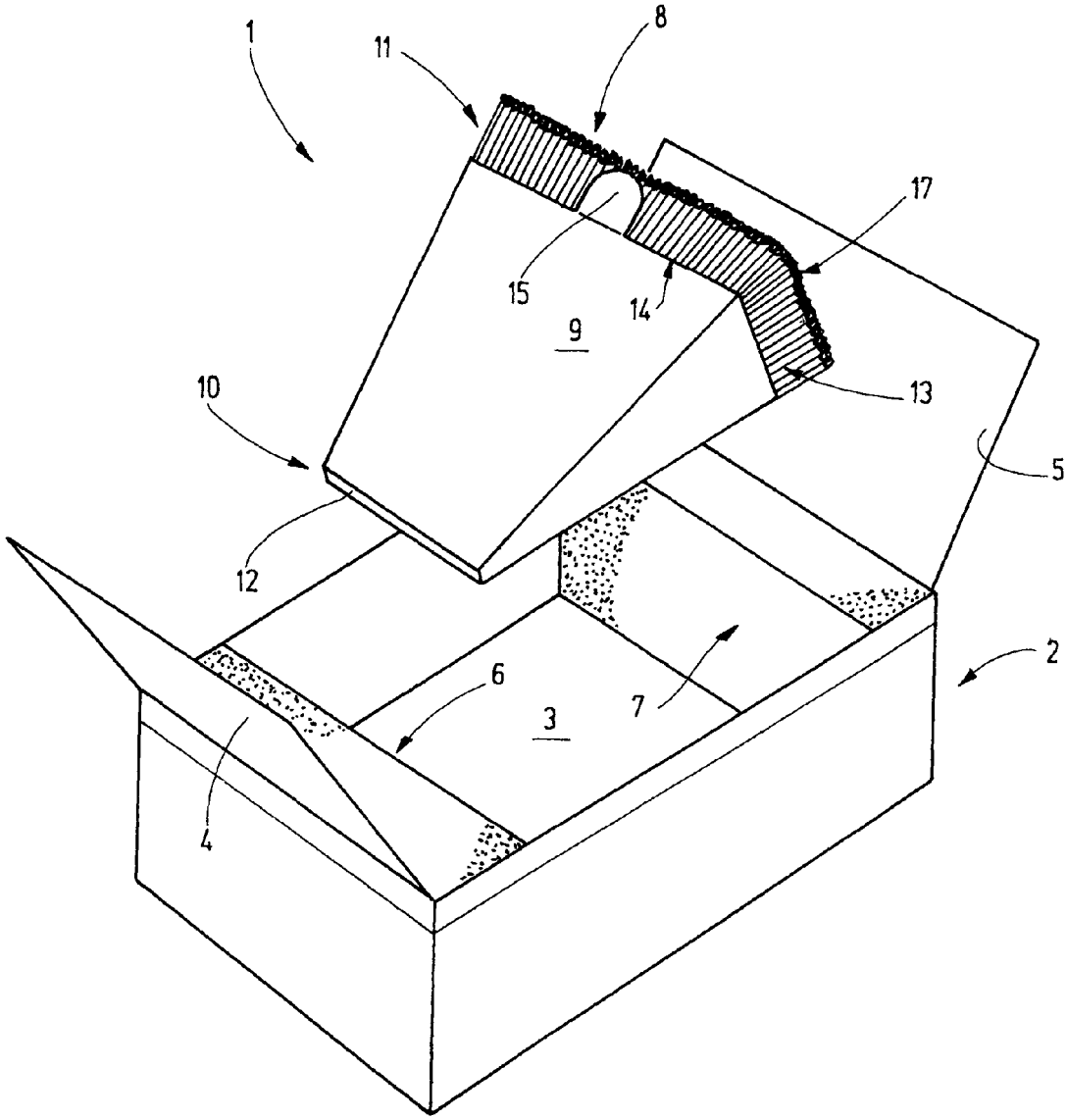
FIG. 1 is a perspective illustration of the needle package according to the invention, shown in an open state.

FIG. 1 shows a needle package 1 in an open state. The needle package 1 comprises a preferably plastic, for example, cuboid box 2 whose lid is removed in FIG. 1 and is therefore not shown. In the box 2 an oil paper 3 is placed, whose ends 4 and 5 project from the narrow sides of the box 2. The oil paper 3 preferably occupies the entire width of the inner space of the box 2. At the two end faces of the box 2 buffers 6, 7 are positioned which are cuboid blocks and which are preferably of foam rubber or another suitable material. Between the buffers 6, 7 a free space is provided for receiving a quantity of felting needles 8. In the present embodiment, for example, 250 felting needles are received together in a receptacle 9 which is preferably of a plastic material, such as PE. The receptacle 9 has the basic shape of a truncated pyramid and thus has in essence the shape of a wedge. Its four lateral faces are trapezoidal, and the oppositely-located lateral faces are congruent. In accordance with its wedge shape, the receptacle 9 extends from a narrow side 10 to a wide side 11. The receptacle 9 is preferably closed by an end wall 12 at the narrow side 10. At its wide side 11 the receptacle 9 has an opening 13 occupying the entire cross section of the receptacle 9. The opening 13 is surrounded by a rectangular rim 14, on which one or several tabs 15 may be provided. The tabs 15 extend preferably approximately centrally away from the long edges of the rim 14 and lie preferably in a common plane with the respective lateral face of the receptacle 9 which they join.

Figure 2:
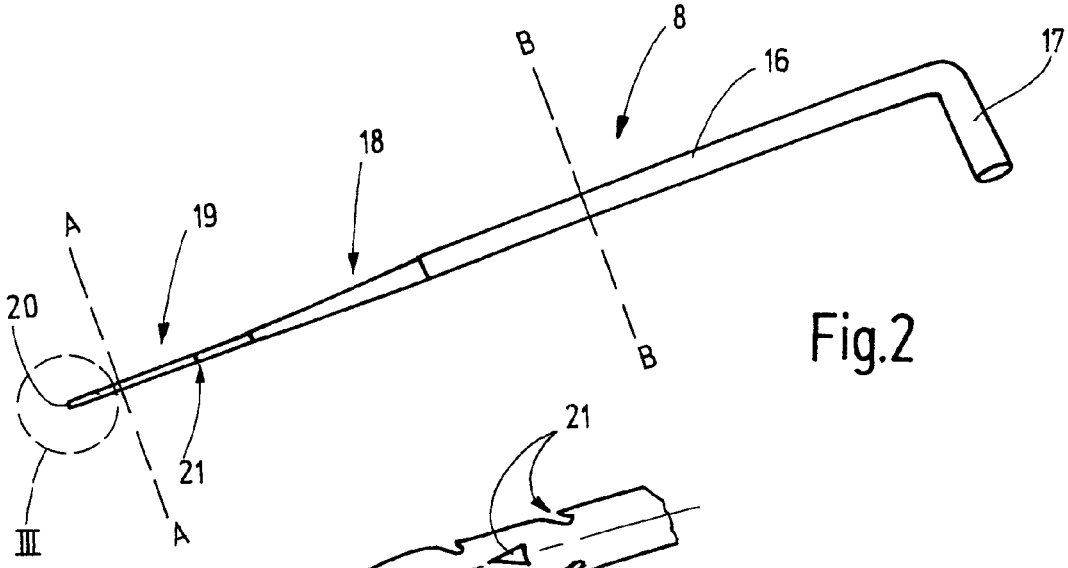
FIG. 2 is a perspective, basic illustration of a felting needle or a fork needle.

The felting needles 8 or fork needles arranged in the receptacle 9 are preferably of identical structure. Such a felting needle 8 is illustrated in FIG. 2. It has a shank 16 which is, for example, of circular cross section and which may have, at its upper end, an angled part which forms a foot 17. At the opposite end, the shank 16 tapers and changes into a transitional region 18 which merges into a working part 19. The latter terminates in a tip 20 and is provided with one or more barbs 21. Details of a felting needle are shown in FIG. 3, while details of as fork needle are shown in FIG. 5.

Figure 3:
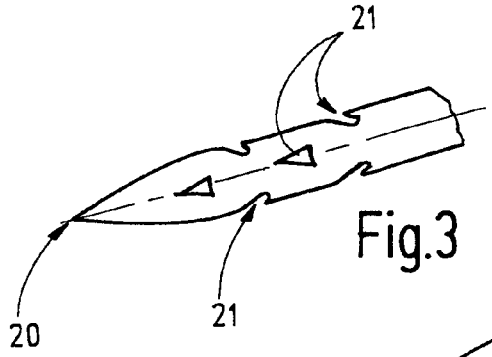
FIG. 3 shows, on a different scale, a tip of the working part of the felting needle of FIG. 2.

FIG. 3 shows the working part 19 of a felting needle 8. The barbs 21 are provided on the flanks of the working part 19. The latter terminates in a tapering tip 20. Dependent on the application of a felting needle, a working part 19 is provided with at least one or more flanks and has at least one or more barbs 21 which may be identically or differently oriented.

Figure 5:
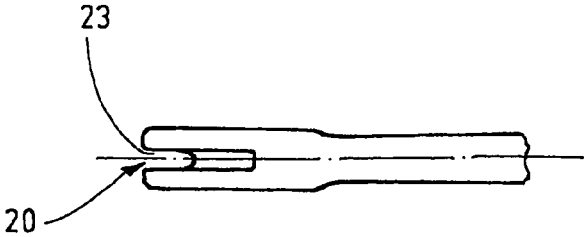
FIG. 5 is a perspective, basic illustration of a tip of the working part of a fork needle according to FIG. 2.

FIG. 5 shows the working part 19 of a fork needle or structuring needle, whose tip 20 has a fork-shaped opening 23 for effecting structural changes in textile surfaces.

The felting needles or fork needles 8 (FIG. 2) taper from their foot 17 toward their tip 20. Therefore, the cross-sectional surface of the felting needle 8 in the vicinity of its tip 20, for example, at the line A-A, is significantly smaller than the cross-sectional surface of the shank 16 of the felting needle 8 approximately in the region of the rim 14 of the receptacle 9, as indicated by the line B-B in FIG. 2. The surface ratio of the two cross-sectional surfaces corresponds to the ratio of the cross-sectional surfaces of the receptacle 9, cut parallel to its end wall 12, approximately at the same locations as indicated by lines A-A and B-B.

For packing the felt needles or structuring needles 8, they are introduced into the receptacle 9 closely side-by-side, approximately as shown in FIG. 1, so that they lie play-free in the receptacle 9. In the present embodiment the tips 20 do not touch the end wall 12; rather, a clearance of a few millimeters remains between the tips 20 and the end wall 12 for preventing the tips 20 from abutting and from deforming. The laterally contacting felting needles 8 can also not cause bending one needle by another. Anti-rust oil adhering to the felting needles 8 is retained between them by capillary action. In the box 2 the receptacle 9 engages the buffer 6 with its end wall 12. On the other hand, the feet 17 of the felting needles 8 lie against the buffer 7. In this manner, the felting needles 8 are held in a play-free manner and thus withstand even a carelessly rough transportation without endangering the working parts of the felt needles 8. The receptacle may be slightly elastic, whereby the firmly immobilized needles are securely held.

After the package 1 has reached its destination, the box 2 is opened and the ends 4, 5 of the oil paper are folded away from one another. The truncated pyramid-shaped receptacle 9 may then be grasped at its tab 15 and lifted up by passing a finger tip underneath the tab 15 and holding the tab 15 with two fingers. The entire needle packet may then be easily lifted out of the box 2. In this manner, with a few hand manipulations a needle packet of, for example, 250 needles may be removed. The handling of the needles is thus simplified and, furthermore, it is many times faster and more comfortable than before. When the truncated pyramid-shaped receptacle 9 is removed from the box 2, the operator may hold it with one hand between two fingers. The operator, dependent on the type of needle fitting, may pull out one or more needles with the other hand and insert them into the needle board of a felting machine.

The truncated pyramid-shaped receptacle prevents the felting needles 8 from being grasped directly at their working parts 19. Such a step is neither needed nor is it possible. This significantly reduces the danger of injuries by the barbs, fork or tip 20. The felting needles or fork needles 8 are grasped only at their feet 17.

The truncated pyramid-like shape ensures that the felting needles 8 are immobilized in the receptacle 9 essentially in a mutually parallel orientation to ensure that the working parts 19 will not be bent. The needles do not abut with their front tips 20. Also, no damages of the working parts 19 may occur by tips rubbing against tips or feet rubbing against tips as it has been possible and as it has occurred frequently in conventional packages.

The felting needles 8 are in a compressed state in the receptacle 9. For wetting the felting needles 8 less anti-rust means is needed than if the felting needles are arranged loosely in a box. Furthermore, the danger of the anti-rust means dripping from the felting needles 8 onto the box bottom and remaining there more or less without being active is drastically reduced. Each truncated pyramid-shaped receptacle 9 is a container which is closed on five sides and which provides for a space for wetted needles and thus assists in retaining the anti-rust means at locations where it is needed. The open side 11 of the receptacle 9 is closed by the snugly side-by-side lying shanks 16.

The container 9 is particularly adapted for all felting needles which have a fineness of gauge 38 and finer. Further, all crown needles having a fineness of gauge 36 and finer may be packed into the receptacle 9. Further, fork needles of a fineness from 36 to 43 gauge may be packed into the receptacle 9. In general, the receptacle is adapted for all needle lengths from 2.5 to 3.5 inches.

While FIG. 1 shows but a single receptacle 9 with felting needles 8, it is noted that it is feasible to arrange two or more receptacles 9 in the inner space enclosed by the box 2. The receptacles 9 may be arranged in an opposite orientation for efficiently utilizing the inner space of the box 2. The above discussion respectively applies for each receptacle disposed in the inner space. Despite the opposite orientation, the felting needles 8 in each receptacle 9 are protected with such a degree of safety that damages to the felting needles 8 are excluded to a great extent. Further, the handling, as set forth above, is simple and danger-free.

Figure 4:
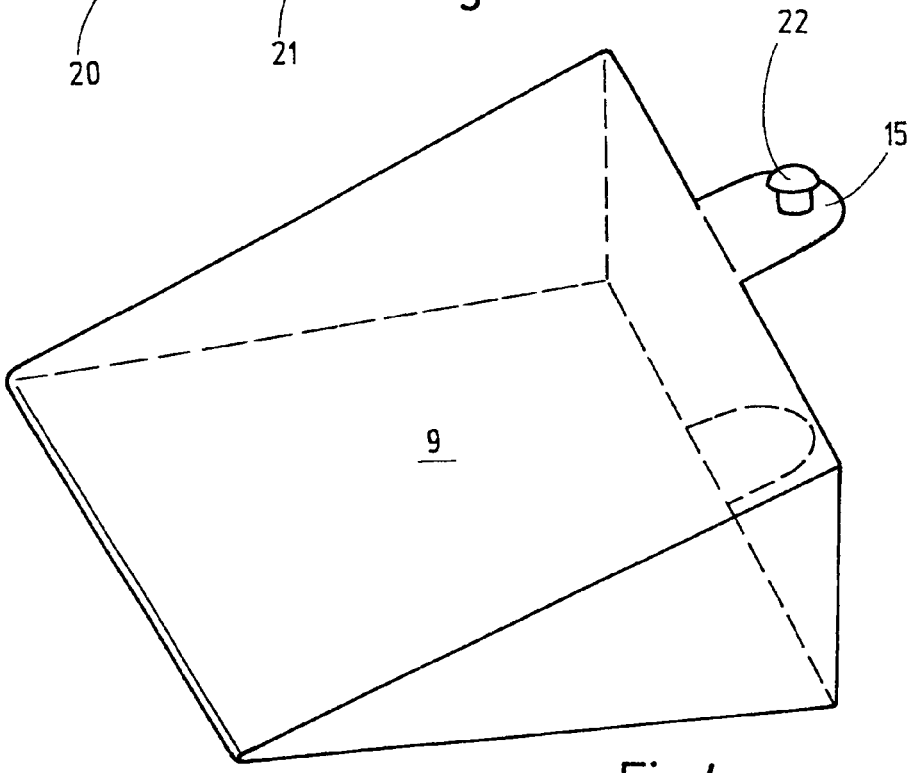
FIG. 4 shows a modified embodiment of a receptacle for a package according to FIG. 1

FIG. 4 shows a slightly modified configuration of the receptacle 9. The difference resides in the provision, on the tab 15, of a securing means 22 in the form of a projection, for example, a pin with a mushroom head. After being removed from the box 2, this embodiment of the receptacle 9 is adapted to be suspended from a suitable carrier which, for example, is provided with a hole. The felting needles may then be easily removed from the suspended receptacle. It is also feasible to provide the securing means 22 in the form of a hole 22 in the tab or in the form of other means with which the receptacle 9 may be suspended.

A wedge-shaped receptacle 9 is provided for packaging felting needles 8. The wedge shape is configured in such a manner that the felting needles lie in the receptacle in a mutual lateral engagement, that is, they are held approximately parallel to one another and they firmly clamp one another without their tips abutting against the receptacle body. This, on the one hand, results in a particular protection of the felting needles 8 during transportation and, on the other hand, results in a simple handling with the lowest danger of injuries.

LIST OF REFERENCE CHARACTERS

1 needle package
2 box
3 oil paper
4, 5 ends
6, 7 buffer
8 felting needles, fork needles, needles
9 receptacle
10, 11 side
12 end wall
13 opening
14 rim
15 tabs
16 shank
17 foot
18 transitional region
19 working part
20 tip
21 barbs
22 securing means
23 opening

The invention claimed is:

1. A needle package comprising:

a wedge-shaped receptacle having a narrow side and a wide side, with the receptacle being open at its wide side and having a closed structure at its narrow side, said receptacle having a rectangular cross section that is oriented parallel to the opening forming the open side and that continuously increases from the narrow side toward the wide side both along its length and its width so that the receptacle has the shape of a truncated pyramid;

a predetermined quantity of felting needles or fork needles disposed in the receptacle; and, wherein the cross section of the receptacle and a cross-section of the quantity of needles are coordinated with one another so that tips of the needles, when the latter are arranged in the receptacle in the predetermined quantity, are held at a distance from the dosed side of the receptacle.

2. The needle package as defined in claim 1, wherein a ratio between a respective cross-sectional surface of the felting needle at a shank thereof and at a working part thereof equals the ratio between the cross-sectional surface of the receptacle at the wide side and the cross-sectional surface of the receptacle at the narrow side.

3. The needle package as defined in claim 1, wherein the receptacle is formed of a plastic material.

4. The needle package as defined in claim 1, wherein the receptacle is formed of a flexible, at least slightly elastic plastic material.

5. The needle package as defined in claim 1, wherein the receptacle is arranged in a box.

6. The needle package as defined in claim 5, wherein the box is formed of a plastic material.

7. The needle package as defined in claim 5, wherein at least one buffer is arranged in the box at the narrow side of the receptacle and at the wide side of the receptacle.

8. The needle package as defined in claim 5, wherein an oil paper is arranged in the box and envelopes the receptacle.

9. The needle package as defined in claim 1, wherein the needles are arranged in the receptacle exclusively in an identical orientation.

10. The needle package as defined in claim 9, wherein the needles each have a circular shank having a foot at one end and tapering toward a respective tip, with the needles being arranged in the receptacle exclusively in an identical orientation with their respective tips facing the closed side of the receptacle.

* * * * *